US010590686B2

(12) United States Patent
Zhang et al.

(10) Patent No.: US 10,590,686 B2
(45) Date of Patent: Mar. 17, 2020

(54) LEFT-AND-RIGHT DOOR OPENING MECHANISM AND REFRIGERATOR

(71) Applicant: QINGDAO HAIER JOINT STOCK CO., LTD., Qingdao, Shandong Province (CN)

(72) Inventors: Hao Zhang, Qingdao (CN); Enpin Xia, Qingdao (CN); Guoshun He, Qingdao (CN); Xiaobing Zhu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/326,176

(22) PCT Filed: Dec. 29, 2016

(86) PCT No.: PCT/CN2016/112817

§ 371 (c)(1),
(2) Date: Feb. 15, 2019

(87) PCT Pub. No.: WO2018/032690

PCT Pub. Date: Feb. 22, 2018

(65) Prior Publication Data

US 2019/0186182 A1 Jun. 20, 2019

(30) Foreign Application Priority Data

Aug. 16, 2016 (CN) ..... 2016 1 0681575

(51) Int. Cl.
*E05D 7/02* (2006.01)
*E05D 7/12* (2006.01)
*F25D 23/02* (2006.01)

(52) U.S. Cl.
CPC ..... *E05D 7/02* (2013.01); *E05D 7/12* (2013.01); *F25D 23/028* (2013.01);
(Continued)

(58) Field of Classification Search
CPC .. F25D 23/02; F25D 23/028; F25D 2323/022; F25D 2323/024; E05D 7/02; E05Y 2900/31
See application file for complete search history.

(56) References Cited

U.S. PATENT DOCUMENTS 3,889,419 A * 6/1975 Maleck ..... E05D 15/505 49/193
4,503,582 A 3/1985 Gurubatham
(Continued)

FOREIGN PATENT DOCUMENTS

CN 1070977 A 4/1993
CN 1155034 A 7/1997
(Continued)

OTHER PUBLICATIONS

CN202692585U Translation, 9 pages (Year: 2013).*

*Primary Examiner* — Andrew M Roersma
(74) *Attorney, Agent, or Firm* — Cheng-Ju Chiang

(57) ABSTRACT

A left-and-right door opening mechanism comprises a locking box assembly disposed on a refrigerator body and a hinge module disposed on a refrigerator door body. The hinge module comprises a first hinge and a second hinge. The locking box assembly comprises a locking box body and a locking plate. A first opening and a second opening are respectively formed in two sides of the locking box body. A first groove and a second groove are respectively formed in two sides of the locking plate. The locking plate moves in the locking box body to align the first opening with the first groove or to align the second opening with the second groove. The first hinge or the second hinge is disengaged from the first opening and the first groove or from the second opening and the second groove to realize door opening from the left side or the right side.

8 Claims, 9 Drawing Sheets

(52) U.S. Cl.
CPC ..... *E05D 2007/128* (2013.01); *E05Y 2900/31* (2013.01); *F25D 2323/022* (2013.01); *F25D 2323/024* (2013.01)

(56) References Cited

U.S. PATENT DOCUMENTS 5,829,197 A * 11/1998 Oh ..... E05D 15/505 49/193
2008/0172838 A1 7/2008 Choi

FOREIGN PATENT DOCUMENTS

| | | | | | |
|---|---|---|---|---|---|
| CN | 202692585 | U | | 1/2013 | |
| CN | 104075531 | A | | 10/2014 | |
| CN | 104677021 | A | | 6/2015 | |
| JP | H6-101956 | A | | 4/1994 | |
| JP | H6-212853 | A | | 8/1994 | |
| JP | 2005068996 | A | * | 3/2005 | |
| WO | 93/09323 | A1 | | 5/1993 | |
| WO | WO-2015078312 | A1 | * | 6/2015 | ..... F25D 23/028 |

* cited by examiner

LEFT-AND-RIGHT DOOR OPENING MECHANISM AND REFRIGERATOR

The present application is a 35 U.S.C. § 371 National Phase conversion of International (PCT) Patent Application No. PCT/CN2016/112817, filed on Dec. 29, 2016, which claims the priority of the Chinese Patent Application No. 201610681575.3, filed to the Chinese Patent Office on Aug. 16, 2016 and titled "Left-and-right Door Opening Mechanism and Refrigerator", which is incorporated herein by reference in its entirety. The PCT International Patent Application was filed and published in Chinese.

TECHNICAL FIELD

The present invention relates to the field of household appliance technology and in particular to a left-and-right door opening mechanism and a refrigerator.

BACKGROUND

Currently, refrigerators on the market for sale are generally opened from the left side. Some refrigerators may also be opened from the right side, but this requires a post-sales engineer to replace hinges or to change the positions of the hinges on site. This demands much on the skills of the post-sales engineer, and deteriorates the use experience of users.

In view of the above problems, it is necessary to provide a left-and-right door opening mechanism and a refrigerator.

SUMMARY

To solve the problems in the prior art, the present invention provides a left-and-right door opening mechanism and a refrigerator. The refrigerator may be opened from the left side or the right side.

The technical solution is implemented as below to solve the above-mentioned technical problems.

A left-and-right door opening mechanism comprises a locking box assembly disposed on a refrigerator body and a hinge module disposed on a refrigerator door body. The hinge module comprises a first hinge and a second hinge which are respectively located on two sides of the refrigerator door body. The locking box assembly comprises a locking box body and a locking plate located in the locking box body. A first opening and a second opening are respectively formed in a left side and a right side of the locking box body. A first groove and a second groove are respectively formed in the left side and the right side of the locking plate. A distance between the first groove and the second groove is smaller than a distance between the first opening and the second opening. The locking plate moves left and right in the locking box body to align the first opening with the first groove or to align the second opening with the second groove. Thus, the first hinge or the second hinge is disengaged from the first opening and the first groove or from the second opening and the second groove to realize door opening from the left side or the right side.

As an improvement of the present invention, the locking plate comprises a locking plate main body portion, as well as a first locking plate bent portion and a second locking plate bent portion which are respectively located on two sides of the locking plate main body portion. The first groove is located between the locking plate main body portion and the first locking plate bent portion. The second groove is located between the locking plate main body portion and the second locking plate bent portion. At least one of the first locking plate bent portion and the second locking plate bent portion covers part of the first opening or the second opening, so that at least one of the first hinge and the second hinge is clamped with and secured to the locking box body.

As a further improvement of the present invention, end portions of the first locking plate bent portion and the second locking plate bent portion are configured as guide surfaces.

As a further improvement of the present invention, the locking box body comprises a first locking box body and a second locking box body which are clamped with each other. The locking plate is located between the first locking box body and the second locking box body.

As a further improvement of the present invention, a stabilizing assembly is disposed on the locking box body. A plurality of buckle portions configured to work together with the stabilizing assembly is disposed on the locking plate. When the left-and-right door opening mechanism is in an open or closed status, the stabilizing assembly is abutted against and secured to the different buckle portions.

As a further improvement of the present invention, the buckle portions comprise a first buckle portion located on the locking plate, as well as a second buckle portion and a third buckle portion which are located beside the first buckle portion and respectively toward the first groove and the second groove. When the left-and-right door opening mechanism is closed, the stabilizing assembly is abutted against and secured to the first buckle portion. When the left-and-right door opening mechanism is opened from the side of the first groove, the stabilizing assembly is abutted against and secured to the third buckle portion. When the left-and-right door opening mechanism is opened from the side of the second groove, the stabilizing assembly is abutted against and secured to the second buckle portion.

As a further improvement of the present invention, the stabilizing assembly comprises a fastener fixedly mounted on the locking box body, a fixing element accommodated in the buckle portions, and an elastic element located between the fastener and the fixing element.

As a further improvement of the present invention, the fixing element is configured as a spherical fixing part. The buckle portions are configured as spherical grooves.

As a further improvement of the present invention, a portion inside the locking box body and in contact with the locking plate provided a plurality of convex rib structures.

Correspondingly, the present invention further discloses a refrigerator which comprises the above-mentioned left-and-right door opening mechanism.

The present invention has the following beneficial effects:

The hinge module and the locking box assembly are respectively disposed on the door body and the refrigerator body, so that door opening from the left side and the right side may be realized; and The door body may be opened and closed smoothly without blockage or abnormal knocking sound, and may not drop off in this process, and meanwhile, an extremely good use experience is brought for a user.

DETAILED DESCRIPTION

Figure 1:
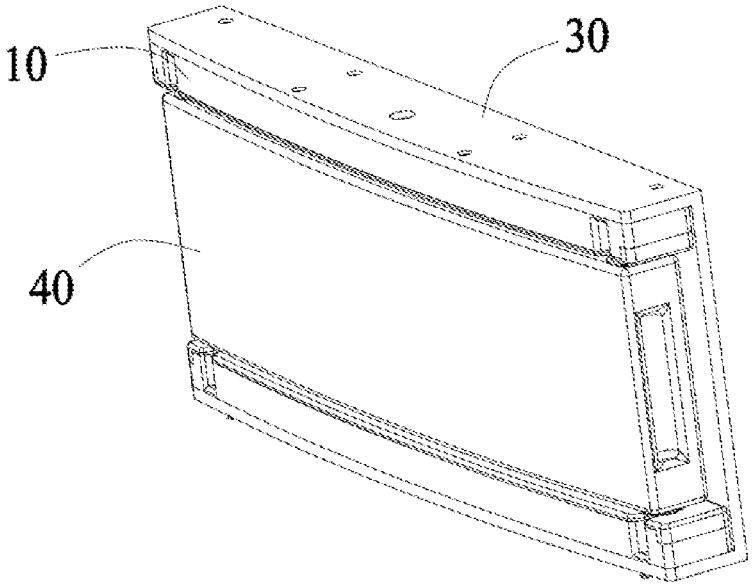
FIG. 1 is a spatial structure schematic view of a left-and-right door opening mechanism according to a specific embodiment of the present invention.

To make the objectives, technical solutions and advantages of the present invention clearer, the specific embodiments of the present invention will be described in detail below with reference to the accompanying drawings. Examples of these preferred embodiments are illustrated in the drawings. The embodiments of the present invention, shown in the drawings and described according to the drawings, are merely exemplary, and the present invention is not limited to these embodiments.

The terms "left", "right", "left side", "right side", and the like as used here, which denote spatial relative positions, describe the relationship of a component relative to another component in the accompanying drawings for the purpose of illustration. The terms of the spatial relative positions may be intended to include different orientations of the device in use or operation other than the orientations shown in the accompanying drawings. For example, the units that are described as being located on the "right side" of other units or features will be located on the "left side" of other units or features if the device in the accompanying drawings is turned upside down. Thus, the exemplary term "right side" can encompass both the orientations of left side and right side. The device may be otherwise oriented (rotated by 90 degrees or facing other directions) and the space-related descriptors used here are interpreted accordingly.

Figure 2:
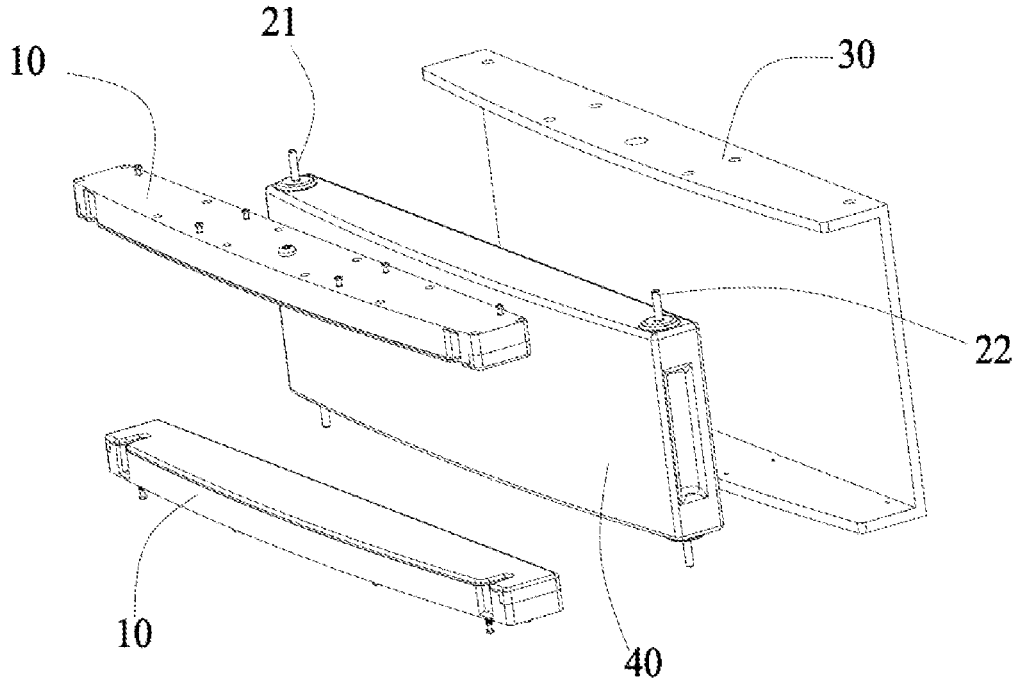
FIG. 2 is an exploded structure schematic view of a left-and-right door opening mechanism according to a specific embodiment of the present invention.

According to a specific embodiment of the present invention, a left-and-right door opening mechanism comprises a locking box assembly disposed on a refrigerator body and a hinge module disposed on a refrigerator door body. As shown in FIG. 1 and FIG. 2, the locking box assembly 10 is disposed on the refrigerator body 30. The hinge module comprises a first hinge 21 and a second hinge 22, which are respectively located on two sides of the refrigerator door body and respectively mounted at two ends of the refrigerator door body 40.

In the embodiment, both upper part and lower part of the refrigerator door body 40 are provided with the hinge module. Correspondingly, both upper part and lower part of the refrigerator door body 40 are provided with the locking box assembly. The locking box assembly and the hinge module at the upper part perform synchronous movement with the locking box assembly and the hinge module at the lower part. In the embodiment, the locking box assembly and the hinge module at the upper part are taken as an example for detailed description.

The locking box assembly 10 in the embodiment will be described in detail below with reference to FIGS. 3-6.

The locking box assembly comprises a locking box body. The locking box body in the embodiment comprises a first locking box body 11 and a second locking box body 12 between which a locking plate 13 is disposed. The first locking box body 11 and the second locking box body 12 are fixedly mounted through a fastener 14. After that, an elongated receiving space is formed between the first locking box body 11 and the second locking box body 12. The locking plate 13 is mounted in the receiving space and may move left and right in the receiving space within a certain range.

An opening 111 and an opening 112 are respectively formed in the left end and the right end of the first locking box body 11. An opening 121 and an opening 122 are respectively formed in the left end and the right end of the second locking box body 12. The opening 111 in the first locking box body 11 and the opening 121 in the second locking box body 12 works together to form a first opening in the left side of the locking box body 10. The opening 112 in the first locking box body 11 and the opening 122 in the second locking box body 12 works together to form a second opening in the right side of the locking box body 10. The first opening and the second opening are in symmetrical distribution, and the opening direction thereof is the same perpendicularly outward direction along the refrigerator body (namely, the door opening direction).

The locking plate 13 comprises a locking plate main body portion 1301, as well as a first locking plate bent portion 1302 and a second locking plate bent portion 1303 which are located on two sides of the locking plate main body portion 1301. A first groove 131 is formed between the first locking plate bent portion 1302 and the locking plate main body portion 1301. A second groove 132 is formed between the second locking plate bent portion 1303 and the locking plate main body portion 1301. The first groove 131 and the second groove 132 are in symmetrical distribution, and opening directions thereof are located on the same side as the opening directions of the first opening and the second opening.

Figure 3:
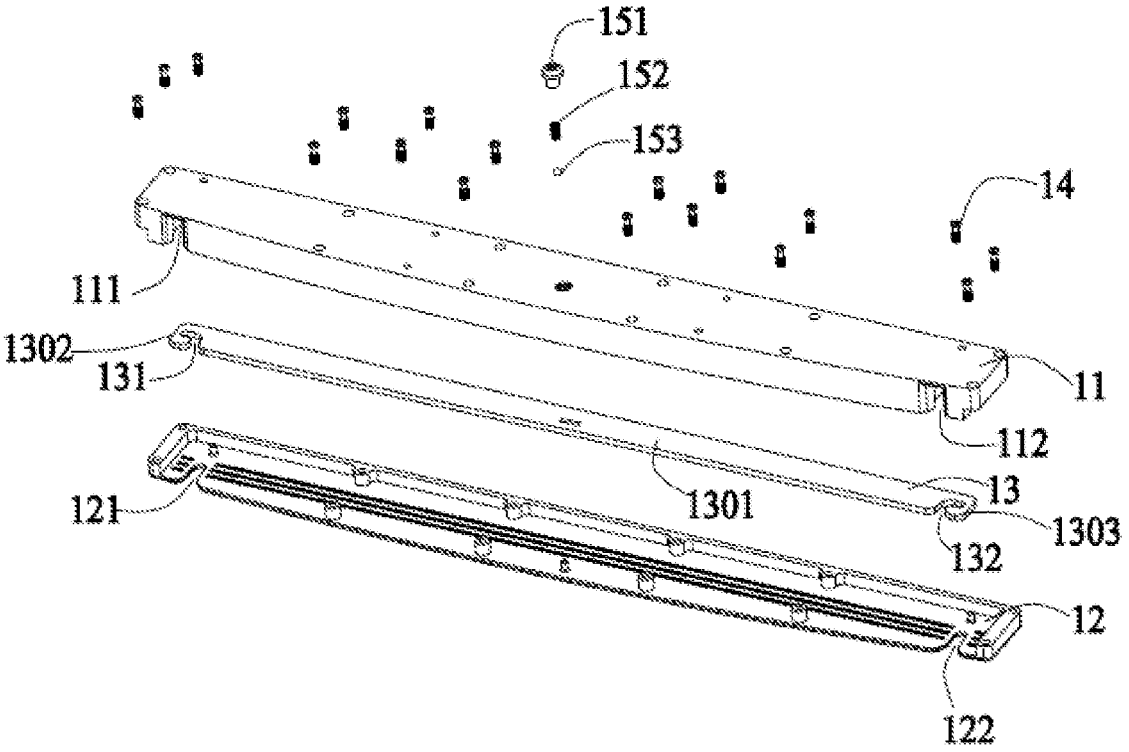
FIG. 3 is an exploded structure schematic view of a locking box assembly according to a specific embodiment of the present invention.
Figure 4:
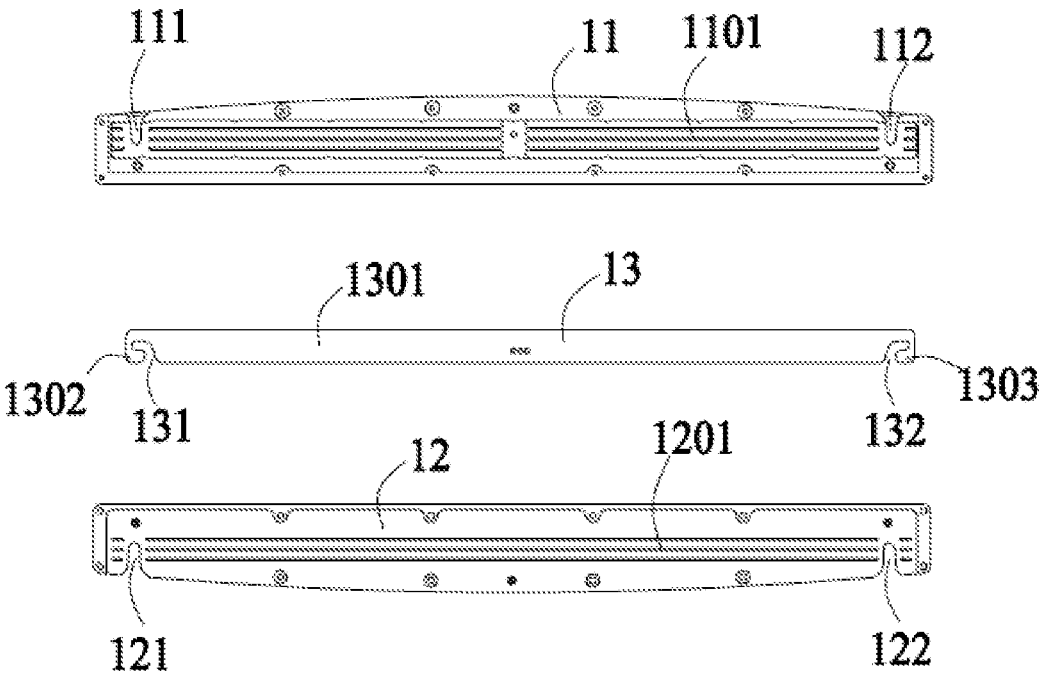
FIG. 4 is a planar structure schematic view of a locking box assembly according to a specific embodiment of the present invention.
Figure 6:
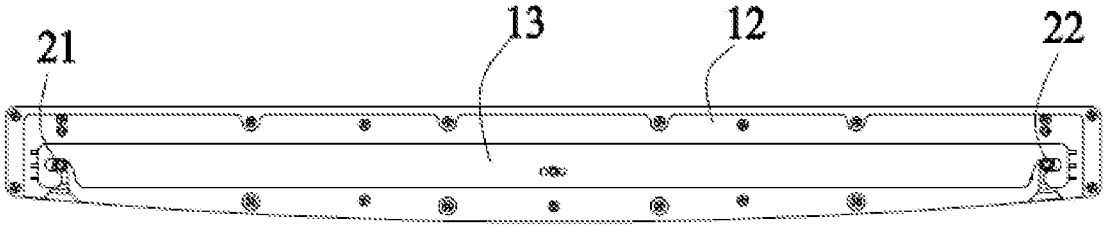
FIG. 6 is an assembly structure schematic view of a locking plate and a second locking box body when a door body is closed according to a specific embodiment of the present invention.

As shown in FIG. 3, FIG. 4 and FIG. 6, end portions of the first locking plate bent portion 1302 and the second locking plate bent portion 1303 are configured as guide surfaces. In the embodiment, an arc surface is taken as an example for description. The guide surfaces are configured to guide the first hinge or the second hinge to move in an extending direction of the first groove or the second groove, such that the first hinge or the second hinge is disengaged from the first groove or the second groove.

As shown in FIG. 6, a distance between the first groove 131 and the second groove 132 is smaller than that between the first opening and the second opening. At least one of the first locking plate bent portion 1302 and the second locking plate bent portion 1303 covers part of the first opening or the second opening, such that at least one of the first hinge and the second hinge is clamped with and secured to the locking box body. The locking plate moves left and right in the locking box body to align the first opening with the first groove 131, or to align the second opening with the second groove 132. Thus, the first hinge 21 or the second hinge 22 is disengaged from the first opening and the first groove or from the second opening and the second groove to realize door opening from the left side or the right side.

Preferably, a stabilizing assembly is disposed on the locking box body in the embodiment. A plurality of buckle portions configured to work together with the stabilizing assembly is disposed on the locking plate. When the left-and-right door opening mechanism is in an open or closed status, the stabilizing assembly is abutted against and secured to the different buckle portions.

Figure 5:
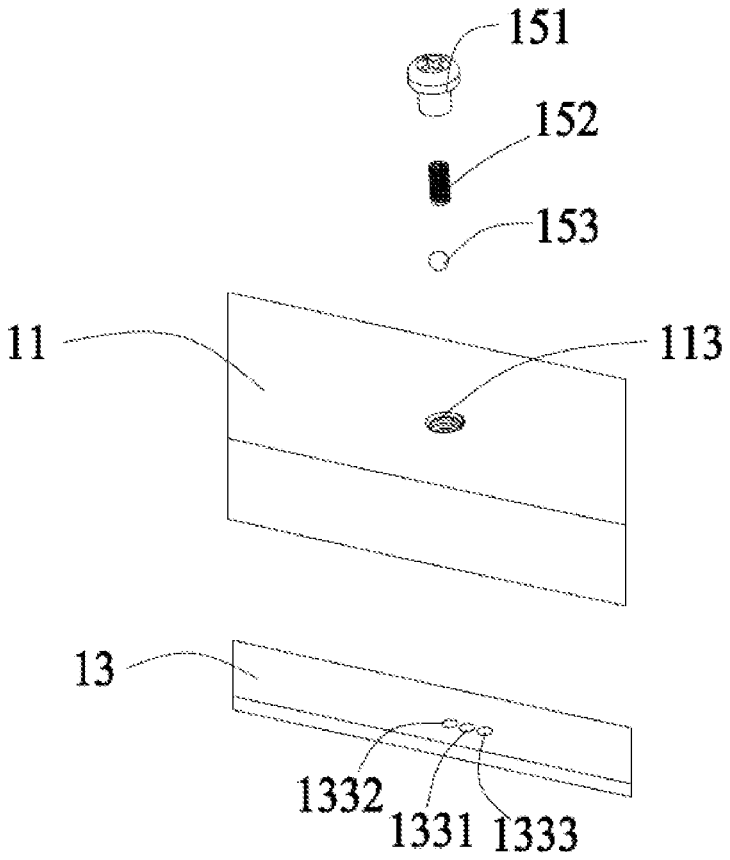
FIG. 5 is an assembly structure schematic view of a stabilizing assembly and a buckle portion according to a specific embodiment of the present invention.

Referring to FIG. 3 and FIG. 5, the stabilizing assembly comprises a fastener 151 fixedly mounted on the locking box body, a fixing element 153 accommodated in the buckle portion, and an elastic element 152 located between the fastener and the fixing element. The fastener 151 is fixedly mounted in a mounting hole 113 in the first locking box body 11. The buckle portions comprise a first buckle portion 1331 located on the locking plate, as well as a second buckle portion 1332 and a third buckle portion 1333 which are located beside the first buckle portion 1331 and respectively toward the first groove 131 and the second groove 132.

Preferably, the fixing element 153 in the embodiment is configured as a spherical fixing part, e.g., a steel ball. The first buckle portion 1331, the second buckle portion 1332 and the third buckle portion 1333 are configured as spherical grooves. In other embodiments, fixing elements and buckle portions in other shapes may also be selected. The number of the buckle portions is not limited to three in the embodiment. Other numbers of buckle portions may be set as required, such that the location of the locking plate may be conveniently fixed during movement.

In the embodiment, when the left-and-right door opening mechanism is closed, the fixing element 153 in the stabilizing assembly is abutted against and secured to the first buckle portion 1331. When the left-and-right door opening mechanism is opened from the side of the first groove 131, the fixing element 153 in the stabilizing assembly is abutted against and secured to the third buckle portion 1333. When the left-and-right door opening mechanism is opened from the side of the second groove 132, the fixing element 153 in the stabilizing assembly is abutted against and secured to the second buckle portion 1332.

Further, a portion inside the locking box body and in contact with the locking plate provided a plurality of convex rib structures. As shown in FIG. 4, a plurality of first convex ribs 1101 is disposed on the inner side of the first locking box body 11 in the embodiment. A plurality of second convex ribs 1201 is disposed on the inner side of the second locking box body 12. The first convex ribs 1101 and the second convex ribs 1201 are respectively in contact with the upper surface and the lower surface of the locking plate 13. Thus, an area of contact between the locking box body and the locking plate may be reduced, and a frictional force therebetween may also be reduced. Hence, the locking plate may move left and right in the locking box body more easily.

The door opening and closing process of the left-and-right door opening mechanism will be described in detail below with reference to the accompanying drawings.

Referring to FIGS. 6-9 which are structural schematic views when the refrigerator body 40 is in a closed status, when the refrigerator body 40 is in the closed status, the locking plate 13 is located in the middle of the locking box body (the first locking box body 11 and the second locking box body 12). The first hinge 21 is located in the first opening (the opening 111 and the opening 121). The second hinge 22 is located in the second opening (the opening 112 and the opening 122). Meanwhile, the first hinge 21 is located in the first groove 131. The second hinge 22 is located in the second groove 132.

Figure 7A:
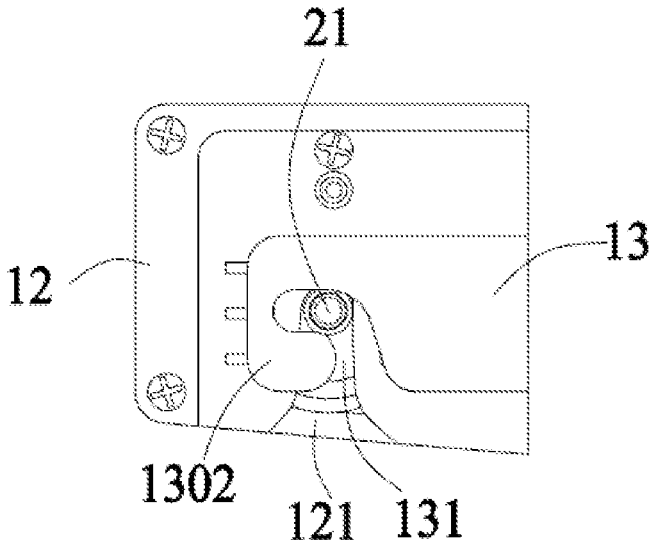
FIGS. 7*a* and 7*b* are schematic views of partial enlarged structures of a left side and a right side in FIG. 6.
Figure 7B:
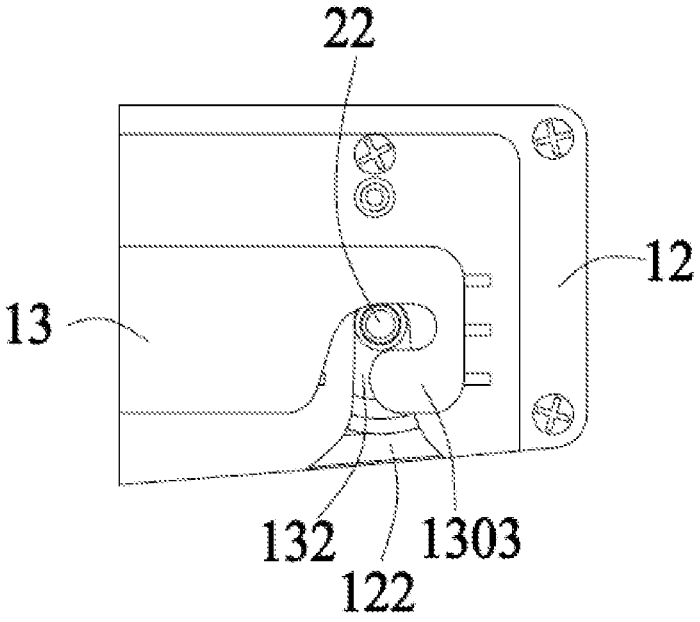
Figure 8:
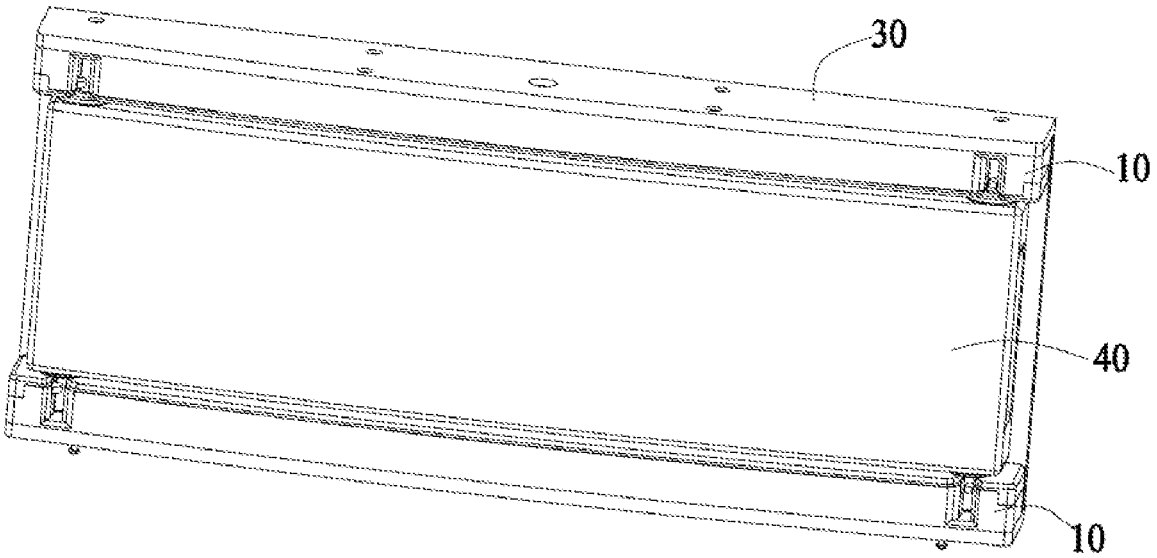
FIG. 8 is a spatial structure schematic view of a left-and-right door opening mechanism when a door body is closed according to a specific embodiment of the present invention.
Figure 9:
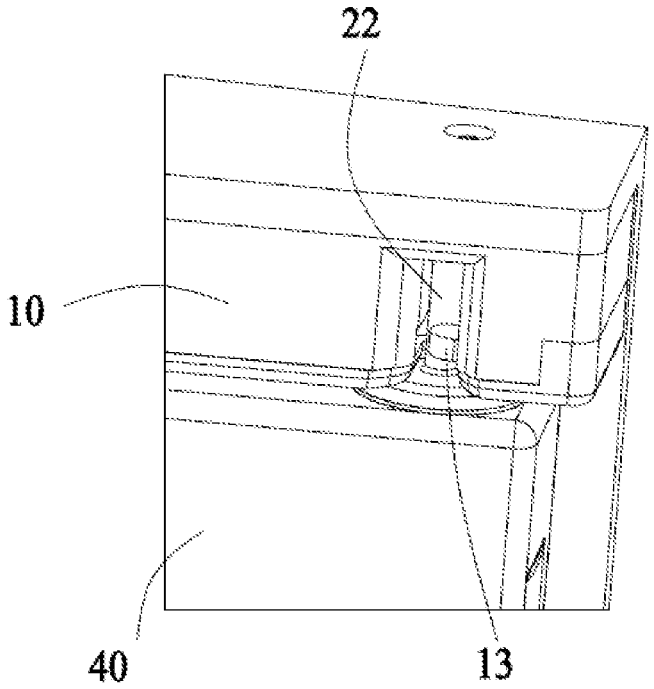
FIG. 9 is a schematic view of a partial enlarged structure of a right side in FIG. 8.

As shown in FIGS. 7*a* and 7*b*, when the refrigerator body 40 is in the closed status, a certain transverse distance exists between the first hinge 21 and the leftmost side of the first groove 131, and a certain transverse distance exists between the second hinge 22 and the rightmost side of the second groove 132. The first hinge 21 and the second hinge 22 are respectively abutted against the guide surfaces of the first locking plate bent portion 1302 and the second locking plate bent portion 1303.

In addition, the fixing element 153 in the stabilizing assembly is abutted against and secured to the first buckle portion 1331.

When door opening is performed from the left side, a handle on the left side of the refrigerator body 40 is pulled. At this time, the first hinge 21 on the left side interacts with the first locking plate bent portion 1302 on the locking plate 13. The guide surface of the first locking plate bent portion 1302 may guide the first hinge 21 to slide along the guide surface. The guide surface may convert movement of the locking plate 13 into left-and-right movement, such that the locking plate 13 slides leftwards. Meanwhile, the second locking plate bent portion 1303 on the right side of the locking plate 13 also slides leftwards and tends to be clamped with the second hinge 22 on the right side of the door body. Meanwhile, the fixing element 153 in the stabilizing assembly slides out of the first buckle portion 1331 and tends to slide to the third buckle portion 1333 on the right side.

The handle on the left side of the refrigerator door body 40 is pulled continuously. The first hinge 21 on the left side is disengaged from the first groove 131 of the locking plate 13. The first hinge 21 on the left side of the refrigerator body is released completely. The second hinge 22 on the right side is clamped by the second groove 132 in the right side of the locking plate 13. The door body is rotated around the second hinge 22 on the right side to be opened. At this time, the fixing element 153 in the stabilizing assembly of the locking plate is located in the third buckle portion 1333 on the rightmost side. The door body is opened.

When the refrigerator door body is closed from the left side, a movement direction of the locking plate 13 is opposite to that when the refrigerator door body is opened from the left side. The first hinge 21 is gradually clamped in the first groove 131 under the guiding action of the first groove 131. The fixing element 153 in the stabilizing assembly of the locking plate gradually moves from the third buckle portion on the rightmost side to the first buckle portion 1331 in the middle. Door closing from the left side will not be described in detail herein.

Moreover, opening or closing of the refrigerator door body from the right side follows the same principle as opening or closing of the refrigerator door body from the left side, and therefore, will not be repeated herein.

In the embodiment, the left-and-right door opening mechanism is described by taking a refrigerator as an example. In other embodiments, the left-and-right door opening mechanism may be applicable to any device that includes a door body and a cabinet body, e.g., a wine cabinet, which will not be elaborated.

Seen from the above technical solution, the present invention has the following beneficial effects:

the hinge module and the locking box assembly are respectively disposed on the door body and the refrigerator body, so that door opening from the left side and the right side may be realized; and The door body may be opened and closed smoothly without blockage or abnormal knocking sound, and may not drop off in this process, and meanwhile, an extremely good use experience is brought for a user.

It should be understood that although the description is described according to the embodiments, not every embodiment only includes one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A left-and-right door opening mechanism, comprising a locking box assembly disposed on a refrigerator body and a hinge module disposed on a refrigerator door body, wherein the hinge module comprises a first hinge and a second hinge which are respectively located on two sides of the refrigerator door body; the locking box assembly comprises a locking box body and a locking plate located in the locking box body; a first opening and a second opening are respectively formed in a left side and a right side of the locking box body; a first groove and a second groove are respectively formed in a left side and a right side of the locking plate; a distance between the first groove and the second groove is smaller than a distance between the first opening and the second opening; the locking plate moves left and right in the locking box body to align the first opening with the first groove or to align the second opening with the second groove; and the first hinge or the second hinge is disengaged from the first opening and the first groove or from the second opening and the second groove to realize door opening from the left side or the right side, wherein a stabilizing assembly is disposed on the locking box body; a plurality of buckle portions configured to work together with the stabilizing assembly is disposed on the locking plate; and when the left-and-right door opening mechanism is in an open or closed status, the stabilizing assembly is abutted against and secured to one of the plurality of buckle portions, wherein the stabilizing assembly comprises a fastener fixedly mounted on the locking box body, a fixing element accommodated in the buckle portions, and an elastic element located between the fastener and the fixing element.

2. The left-and-right door opening mechanism according to claim 1, wherein the locking plate comprises a locking plate main body portion, as well as a first locking plate bent portion and a second locking plate bent portion which are respectively located on two sides of the locking plate main body portion; the first groove is located between the locking plate main body portion and the first locking plate bent portion; the second groove is located between the locking plate main body portion and the second locking plate bent portion; and at least one of the first locking plate bent portion and the second locking plate bent portion covers part of the first opening or the second opening, so that at least one of the first hinge and the second hinge is clamped with and secured to the locking box body.

3. The left-and-right door opening mechanism according to claim 2, wherein end portions of the first locking plate bent portion and the second locking plate bent portion are configured as guide surfaces.

4. The left-and-right door opening mechanism according to claim 1, wherein the locking box body comprises a first locking box body and a second locking box body which are clamped with each other, and the locking plate is located between the first locking box body and the second locking box body.

5. The left-and-right door opening mechanism according to claim 1, wherein the buckle portions comprise a first buckle portion located on the locking plate, as well as a second buckle portion and a third buckle portion which are located beside the first buckle portion and respectively toward the first groove and the second groove; when the left-and-right door opening mechanism is closed, the stabilizing assembly is abutted against and secured to the first buckle portion; when the left-and-right door opening mechanism is opened from the side of the first groove, the stabilizing assembly is abutted against and secured to the third buckle portion; and when the left-and-right door opening mechanism is opened from the side of the second groove, the stabilizing assembly is abutted against and secured to the second buckle portion.

6. The left-and-right door opening mechanism according to claim 1, wherein the fixing element is configured as a spherical fixing part, and the buckle portions are configured as spherical grooves.

7. The left-and-right door opening mechanism according to claim 1, wherein a portion inside the locking box body and in contact with the locking plate provided a plurality of convex rib structures.

8. A refrigerator, comprising the left-and-right door opening mechanism of claim 1.

* * * * *